US007396800B2

(12) United States Patent
Chervin

(10) Patent No.: US 7,396,800 B2
(45) Date of Patent: Jul. 8, 2008

(54) FILM INK SUPPORT MEDIA AND SUBLIMATION DECORATION PROCESS

(75) Inventor: Christophe Chervin, Neydens (FR)

(73) Assignee: E. I. du Pont de Nemours and Company, Wilmington, DE (US)

( * ) Notice: Subject to any disclaimer, the term of this patent is extended or adjusted under 35 U.S.C. 154(b) by 539 days.

(21) Appl. No.: 11/183,630

(22) Filed: Jul. 18, 2005

(65) Prior Publication Data

US 2006/0025306 A1 Feb. 2, 2006

Related U.S. Application Data

(60) Provisional application No. 60/591,530, filed on Jul. 27, 2004.

(51) Int. Cl.
*B41M 5/035* (2006.01)

(52) U.S. Cl. ..... 503/227; 8/471

(58) Field of Classification Search ..... None
See application file for complete search history.

(56) References Cited

U.S. PATENT DOCUMENTS 5,308,426 A 5/1994 Claveau
5,893,964 A 4/1999 Claveau
5,962,368 A 10/1999 Poole
6,524,419 B1 2/2003 Dabrowski, Jr. et al.

FOREIGN PATENT DOCUMENTS

| | | |
|---|---|---|
| DE | 9017502 U1 | 5/1991 |
| EP | 1088677 A1 | 4/2001 |
| EP | 0950540 B1 | 3/2002 |
| EP | 1338432 A2 | 8/2003 |

OTHER PUBLICATIONS

International Search Report for PCT/US2005/026683 dated Nov. 7, 2005.

*Primary Examiner*—Bruce H Hess

(57) ABSTRACT

A sublimation ink carrier media is provided comprising a support sheet with a polymer film where a sublimation ink is printed in a pattern on the planar surface of the film. The polymer film is peelable from the planar surface of the support sheet, the polymer film is substantially non-extensible when the film is attached to the support sheet, the polymer film is extensible after being peeled from said carrier support sheet, and the polymer film has a melting temperature of at least 190° C. A process for the decoration of a shaped article by ink sublimation using the sublimation ink carrier media of the invention is also provided.

20 Claims, 1 Drawing Sheet

FILM INK SUPPORT MEDIA AND SUBLIMATION DECORATION PROCESS

CROSS REFERENCE TO RELATED APPLICATION

This application claims the benefit of U.S. Provisional Application No. 60/591,530 filed Jul. 27, 2004.

FIELD OF THE INVENTION

This invention relates to a process for the decoration of shaped objects by ink sublimation. The invention also relates to a sublimation ink carrier media for use in such a process. More specifically, the invention relates to an ink carrier media for use in a sublimation decoration process, which media does not stretch during the printing of sublimation ink on the ink carrier media, but which media is able to be stretched over a shaped object when the printed sublimation ink is applied to the surface of a shaped object during sublimation decoration.

BACKGROUND OF THE INVENTION

Paper, plastic, glass and metal substrates and shaped objects have been decorated by transfer printing with a sublimation ink. According to this process, a sublimation ink is first applied to an ink carrier media such as a paper sheet. The ink carrier is held in contact against the surface of the object to be decorated by mechanical means such as a stretchable sheet. The ink carrier media and the surface of the object being decorated are heated to an elevated temperature such that the ink sublimes to a vapor phase that prints onto the surface being decorated. Sublimation inks are made with dispersed dyes such as azo dyes, nitroarylamine dyes or anthraquinone dyes, that when heated, sublime to a gaseous state without passing through a liquid or melt state. These gaseous ink vapors print the surface of the object being decorated.

A device for use in the sublimation printing of shaped objects is disclosed in U.S. Pat. No. 5,893,964 and includes a flexible membrane. An object to be decorated is surrounded with a printed sublimation ink carrier media and placed inside the flexible membrane which is then sealed and evacuated. The atmospheric air pressure outside the flexible membrane presses the ink carrier media against the object to be decorated. The object, ink carrier media, and flexible membrane are then heated to the sublimation temperature of the ink such that the ink sublimes to an ink vapor which prints the surface of the object being decorated.

Sublimation printing of a three dimensional shaped object using a paper ink carrier media has the disadvantage that the paper cannot properly conform to the shape of the surface being decorated. When a flat paper ink carrier is pressed against a three dimensional object, the paper crumples or creases, which causes discontinuities in the image printed on the object surface.

Attempts have been made to overcome this problem by using an ink carrier media that conforms to the surface of a three-dimensional surface being printed. U.S. Pat. No. 5,308,426 discloses ink support materials made of woven fabric, knitted fabric or non-woven material. Although sublimation ink support fabrics offer greater ability to conform to shaped objects than paper, they still exhibit a variety of drawbacks. Many fabrics, such as conventional woven and non-woven fabrics, are not sufficiently flexible and stretchable to be able to conform to the surface of a three dimensional shaped object. Such fabrics bunch or crumple when pressed against a shaped object being decorated in much the same way as occurs with a paper ink support media.

Knit fabrics have been used as a sublimation ink support carrier because they are more extensible than other fabrics and can therefore better conform to the shape of an object. While this extensibility is beneficial during the sublimation step, the same property makes it more difficult to print the sublimation ink onto the carrier media. In many printing processes, such as silk screen printing, heliographic printing and ink jet printing, each color of a design is printed separately, and if the carrier media being printed stretches or contracts between the printing of the various colors, the result is a blurred printed image on both the ink carrier media and the decorated object. In addition, with extensible knitted fabric sublimation ink carriers, when the fabric is stretched over a shaped object during sublimation printing, void spaces in the fabric open up which reduces the sharpness and clarity of the image that is sublimation printed. Along the same lines, extensible knitted fabrics have the property that they are quite porous, especially when stretched. This porosity allows the sublimed ink vapors to pass from the ink carrier media in both the direction of the object being decorated and in the direction of the surrounding flexible membrane such that the flexible membrane quickly becomes contaminated with sublimation inks unless an additional disposable protective sheet is inserted between the ink carrier media and the flexible membrane. Otherwise, during subsequent decorations, the sublimation inks deposited on the membrane can pass back through the porous ink carrier media and randomly deposit on the surface being decorated.

European Patent No. EP 950 540 and U.S. Pat. No. 5,962,368 disclose sublimation ink carrier media comprised of shrinkable films that can be heated so as to conform to the shape of the object being printed. Shrinkable films have the disadvantage that they are difficult to conform to complex shapes. A further disadvantage of shrinkable films is that they often continue to shrink during the sublimation transfer step which tends to cause blurring of the decorated image. Finally, shrinkable films tend to be time consuming to remove after the sublimation step is complete.

As described above, there is a need for a sublimation ink carrier media that does not deform when it is being printed with a pattern or design, but that does extend during sublimation so as to conform to the shape of an object being decorated. There is a further need for a sublimation decoration process with a sublimation ink carrier media that can extend around and conform to the surface of a three dimensional object being decorated, but that does not open up when stretched such that the sublimated decoration loses clarity. Finally, there is a need for a flexible and extensible sublimation ink carrier media and sublimation decoration process wherein the ink carrier media can serve as the sole flexible membrane during the ink sublimation process with no further need for additional protective sheeting outside the ink carrier media.

SUMMARY OF THE INVENTION

The invention provides a sublimation ink carrier media comprising a support sheet having a planar surface and a polymer film having opposite first and second planar surfaces. The support sheet and support sheet planar surface have a machine direction and a substantially perpendicular cross direction, and the support sheet is substantially non-extensible in this machine direction. The film and the film's first and second planar surfaces have a machine direction and a substantially perpendicular cross direction. The first planar surface of the film is attached to the planar surface of the support sheet such that the machine directions of the support sheet and the polymer film are substantially aligned. A sublimation ink is printed in a pattern on the second planar surface of the film. The polymer film is peelable from the planar surface of the support sheet, the polymer film is substantially non-extensible in the machine direction when the film is attached to the support sheet, the polymer film is extensible in the machine and cross directions after being peeled from said carrier support sheet, and the polymer film has a melting temperature of at least 190° C. The polymer film is preferably elastic in the machine and cross directions when peeled from said support sheet. In one embodiment of the invention, the polymer film is comprised of an elastomeric polymer such as a copolyester elastomer.

A process for the decoration of a shaped article by ink sublimation is also provided. The process includes the step of selecting a polymer film and support sheet laminate as described above, feeding the polymer film and support sheet laminate through a printing apparatus in the machine direction of the polymer film and support sheet, printing the surface of the polymer film with one or more sublimation inks in the printing apparatus, peeling the polymer film from the support sheet, pressing the printed surface of the polymer film against the surface of the shaped article to be decorated such that the carrier film is extended and conforms to the surface being decorated, heating the ink printed on the polymer film to a temperature sufficient to sublime the ink to a vapor and decorate the shaped object, and removing the polymer film from the shaped object. According to one preferred embodiment of the invention, the polymer film is elastic in the machine and cross directions after the film is peeled from the support sheet. According to another embodiment of the invention, the step of peeling the polymer film from the support sheet is followed by the steps of forming the film into an airtight pouch, placing the shaped article in the pouch, and applying a vacuum to the inside of the pouch to bring the film into contact with the shaped article.

TEST METHODS

Figure 1:
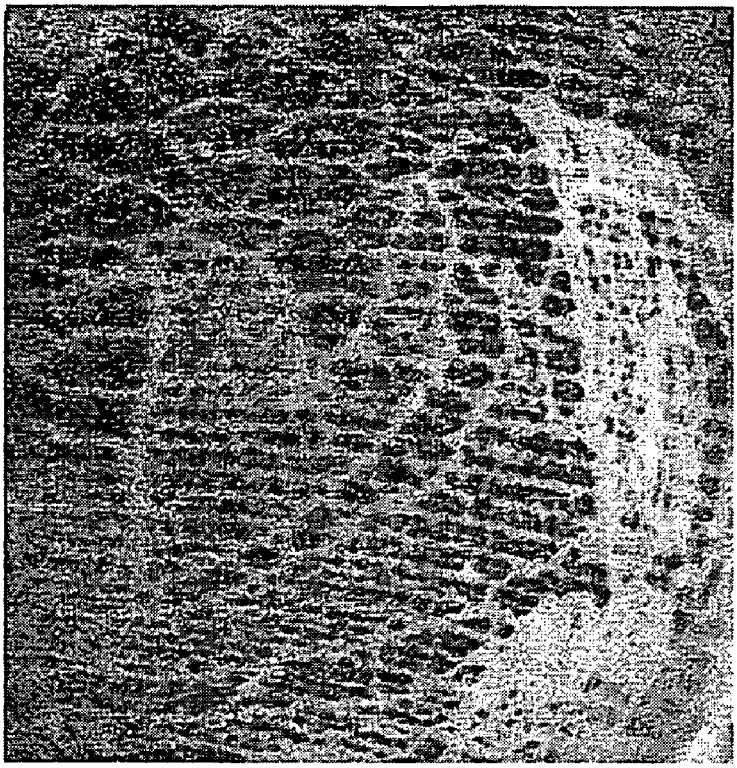
FIG. 1 is a photograph of a sublimated decoration printed with a sublimation ink carrier media according to the prior art.

In the description and in the non-limiting example that follows, the following test methods were employed to determine various reported characteristics and properties. ISO refers to the International Organization for Standardization.

Tensile Strength and Elongation at Yield were measured according to ISO 527-1 & 3. The tensile strength is expressed in MPa and the elongation at yield is expressed as a percent.

Peel Strength was measured according to the following procedure: Five rectangular test specimens, each measuring 15 mm wide by 150 mm long were cut from the film/paper laminate, with the longer edge of each specimen being substantially aligned with the machine direction of the film. The five specimens were selected so as to be evenly spaced over the full width of the film. The film at the top edge of each specimen (along one of the 15 mm edges) was manually separated from the paper and the film was manually peeled from the paper for about 25 mm of the length of the specimen. The separated ends of the film and the paper were inserted into the top and bottom jaws, respectively, of a tensile testing machine. The force required to peel the film from the paper, at a clamp travel speed of 100 mm/minute (crosshead speed), was measured and expressed as Newtons per 1.5 cm. The peel strength is the average of the peeling force measured on the 5 test specimens.

DETAILED DESCRIPTION OF THE INVENTION

The invention provides a sublimation ink carrier media comprised a polymeric film attached to a support sheet. A sublimation ink is printed in a pattern on the polymeric film. The printed polymeric film can be peeled from the support sheet and applied over the surface of a shaped article to be decorated. The film can then be heated to a temperature that causes the sublimation ink to sublimate and transfer to the shaped article being decorated.

The support sheet of the sublimation ink carrier media of the invention has a planar surface. The sheet and its planar surface have a machine direction and a substantially perpendicular cross direction. The support sheet is substantially non-extensible in the machine direction of the support sheet. The support sheet may also be substantially non-extensible in the cross direction.

The polymer film of the sublimation ink carrier media of the invention has opposite first and second planar surfaces. The film, the first planar surface of the film and the second planar surface of the film have a machine direction and a substantially perpendicular cross direction. The first planar surface of the film is attached to the planar surface of the support sheet such that the machine directions of the support sheet and the polymer film are substantially aligned. A sublimation ink is printed in a pattern on the second planar surface of the polymer film.

In the sublimation ink carrier media of the invention, the polymer film is peelable from the planar surface of the support sheet. The polymer film is substantially non-extensible in the machine direction when the polymer film is attached to the support sheet. Where the support sheet is substantially non-extensible in both the machine and cross directions, the polymer film will be substantially non-extensible in both the machine and cross directions when the polymer film is attached to the support sheet. The polymer film is extensible in the machine and cross directions once the film has been peeled from the support sheet. According to the invention, the polymer film has a melting temperature of at least 190° C. such the film does not melt when the film is heated so as to sublimate the sublimation ink.

By extensible, it is meant that the polymer film can be deformed under the amount of tension that is typically applied to an ink carrier media when the media is conformed over the surface of a shaped object being decorated during an ink sublimation process. By substantially non-extensible, it is meant that the support sheet and film do not deform an appreciable amount under the amount of tension that is typically applied to an ink carrier media when the media is being drawn through a printing apparatus or printing process. By peelable, it is meant that the film can be manually peeled from the support sheet without undue effort.

According to a preferred embodiment of the invention, the polymer film is elastic in the machine and cross directions after the film is peeled from the support sheet. By elastic, it is meant that the film extends when stretched under the amount of tension that is typically applied to an ink carrier media when the media is conformed over the surface of a shaped article being decorated, and that the film substantially retracts to its original dimensions when the tension on the film is released as the film is removed from the shaped article. An elastic film conforms well to the surface of a shaped article being decorated, even when the article has a complex three dimensional shape.

According to a preferred embodiment of the invention, the polymer film is comprised of an elastomeric polymer. Such elastomeric polymers include polyamide thermoplastic elastomer (TPA), copolyester thermoplastic elastomer (TPC), urethan thermoplastic elastomer (TPU), thermoplastic rubber vulcanizate (TPV), styrenic thermoplastic elastomers (TPS), and blends thereof. Preferably, the polymer film is comprised of a copolyester elastomer, and more preferably is comprised of a copolyether ester elastomer. A copolyether ester that has been advantageously used in forming the polymer film of the sublimation ink carrier media of the invention is Hytrel® polyester elastomer, which is manufactured and sold by E.I. du Pont de Nemours and Company. These copolyether ester elastomers are multi-block copolymers in which the hard segments and soft segments alternate repeatedly along the polymer backbone. Varying the type and amount of soft segments in the copolyester formulation impacts the physical properties of the polymer. The polymer film may have multiple layers of different thermoplastic elastomers.

Three Hytrel® polyester elastomers that have been effectively used to produce the film of the ink carrier media of the invention are Hytrel® 8238, Hytrel® 7246 and Hytrel® G5544. Hytrel® 8238 is a copolyetherester containing about 92 weight percent of 1,4-butylene terephthalate short-chain ester units and about 8 weight percent of polytetramethylene ether glycol longchain ester units which have a molecular weight of about 1000, this copolyether ester having a melting point of about 220° C., and a melt flow rate of about 13 g/10 minutes measured at a temperature of 240° C. under a 2.16 kg load. Hytrel® 7246 is a copolyetherester containing about 85 weight percent of 1,4-butylene terephthalate short-chain ester units and about 15 weight percent of polytetramethylene ether glycol longchain ester units which have a molecular weight of about 1000, this copolyether ester having a melting point of about 215° C., and a melt flow rate of about 13 g/10 minutes measured at a temperature of 240° C. under a 2.16 kg load. Hytrel® G5544 is a copolyetherester containing about 65 weight percent of 1,4-butylene terephthalate short-chain ester units and about 35 weight percent of ethylene-oxyde end capped polypropylene ether glycol long-chain ester units which have a molecular weight of about 2000, this copolyether ester having a melting point of about 215° C., and a melt flow rate of about 10 g/10 minutes measured at a temperature of 230° C. under a 2.16 kg load.

The presence of a high level of ethylene-oxide end capped polypropylene ether glycol (EO-PPG soft segments) in the polymer film, as in Hytrel® G5544, increases the film elasticity, but also results in a higher permeability to the sublimation ink compared to films having polytetramethylene ether glycol (PTMeG) soft segments. If the film is too permeable to the sublimation ink, the decoration sublimation printed from the carrier media will be less clear, and the film may have trouble containing the sublimation ink making it necessary to surround the sublimation ink carrier film with a disposable sheet during sublimation printing in order to prevent contamination of the sublimation apparatus. Copolyether ester films having PTMeG soft segments offer a good compromise between elasticity and a lower rate of ink migration into the polymer film. However, if the copolyether ester films have too high a percentage of PTMeG soft segments, then the melting point of the film becomes too low for use in an ink sublimation process. In addition, multiple layer co-extruded films can also be used to obtain a good compromise between elasticity and ink migration properties.

In the sublimation ink carrier media of the invention the support sheet is preferably a lightweight paper or synthetic substrate that is substantially non-extensible in the machine direction. More preferably, the support sheet is substantially non-extensible in both the machine and cross directions. A preferred support sheet is a pulp or synthetic paper. It is further preferred that the carrier sheet have a planar surface that is very smooth so as to facilitate peeling of the polymer film from the planar surface of the support sheet. The planar surface of the support sheet may be lightly coated or otherwise treated with a lubricant or other non-stick coating. At the same time, the polymer film must stick to the support sheet such that the polymer film is prevented from stretching until after the film is peeled from the support sheet. One preferred support sheet that has been advantageously used in the sublimation ink carrier media of the invention is a paper with a silica treated planar surface. One such paper is Silica Classic Yellow 924 paper with a basis weight of 62 gr/m$^2$ from Ahlstrom Papiervertrieb GmbH, Munich, Germany.

The polymer film may be extruded onto the support sheet by known film extrusion methods. One preferred method is to melt the polymer used to produce the polymer film in a single screw extruder and then extrude the polymer melt through a flat die directly into a nip between a transfer roll and the planar surface of the support sheet as the sheet is moving around a cast roll. For example, the copolyether ester polymer may be melted in a single screw extruder that produces a melt at 245° C. A preferred process for extruding the polymer film onto the support sheet is a cast film extrusion process. The extruded film preferably has a thickness of from 10 to 30 microns, and more preferably from 15 to 25 microns.

In a preferred embodiment of the invention, the peel strength between the support sheet and the polymer film attached to the support sheet is in the range of 0.1 N/1.5 cm to 1 N/1.5 cm, and is more preferably in the range of 0.2 N/1.5 cm to 0.8 N/1.5 cm. It is further preferred that the polymer film has a tensile strength at yield of at least 4 MPa in the machine and cross directions when the film is peeled from said support sheet. Such a tensile strength keeps the film from breaking or splitting when the film is being peeled from the support sheet and when the peeled film is being manipulated and subsequently stretched over the surface of a shaped article being decorated. The polymer film preferably has an elongation in the machine and cross directions, after the film has been peeled from the support sheet, of at least 0.4% at 5 MPa and more preferably at least 0.8%, and most preferably at least 2.5%.

According to the preferred embodiment of the invention, the polymer film of the sublimation ink carrier media does not become porous when it is stretched under the amount of tension that is typically applied to an ink carrier media when the media is conformed over the surface of a shaped object being decorated by ink sublimation. This lack of porosity makes the film act as an air barrier which makes it possible to use the film as a membrane during the sublimation process without having to use an additional external membrane.

According to the invention, the process for the decoration of a shaped article by ink sublimation first comprises the steps of selecting a sublimation ink carrier media as described above. The polymer film and support sheet laminate are fed through a printing apparatus in the machine direction of the polymer film and support sheet. The exposed planar surface of the polymer film is printed in the printing apparatus with one or more sublimation inks. The printed polymer film is peeled from the support sheet. The printed surface of the polymer film is pressed against the surface of a shaped article to be decorated such that the carrier film is extended over and conforms to the surface being decorated. Next, the ink printed on the polymer film is heated to a temperature sufficient to sublimate the ink to a vapor and decorate the surface of the shaped object to which the polymer film is conformed. Finally, the polymer film is removed from the shaped object.

In the printing apparatus, the sublimation inks are preferably printed onto the exposed surface of the polymer film using a conventional printing process such as heliographic printing, ink jet printing or silk screen printing. In a heliographic printing process, the desired images are screened by tiny cells etched to produce tiny indentations on the surfaces of the printing cylinders. The indentations vary in depth and width and are below the non-printing areas of the roll surfaces. The printing cylinders rotate through a bath of ink and the non-printing areas are wiped clean by a doctor blade before the image is directly applied to a substrate to be printed. The inks are designed to print from depressed indentations like those found on gravure roll printing cylinders. The ink is very fluid such that it easily fills the thousands of tiny indentations on each of the printing cylinders, and at the same time the ink has enough body (viscosity) and adhesion to be pulled from the wells onto the surface being printed. The consistency of the ink must be maintained to permit the doctor blade to properly clean the plate and ensure a proper transfer of the printed image to the surface being printed. Gravure inks are quick-drying and are usually dried by evaporation in an oven at low temperature (max 40° C.).

The sublimation inks printed on the polymer film of the ink carrier media are heat activated inks that change directly to a gas phase when heated, which gas phase has the ability to bond to a surface being decorated. The sublimation inks used in heliographic printing are normally composed of dispersed dyes in alcohol or water. The dyes include one or more organic pigments that can sublimate directly to a gas phase. The dispersed dyes of sublimation inks are conventionally azo dyes, nitroarylamine dyes or anthraquinone dyes.

The printed carrier film is placed over and conformed to the surface of the object to be decorated. One sublimation apparatus that can be used is described in European No. EP 451 067. In this apparatus, the object to be decorated is first covered with the sublimation ink carrier media, and then inserted between two flexible membranes held by two articulated rigid frames. Another sublimation apparatus that is especially suitable for decorating articles of complex shape is disclosed in U.S. Pat. No. 5,893,964, which apparatus consists of a sealed flexible membrane sack. With this device, an article to be decorated is surrounded by a sublimation ink carrier media and then placed inside the sealed membrane sack. The sack is then evacuated and heated to a pressure in the range of 0.6 to 1.0 bar such that the outside atmospheric pressure presses the sublimation ink carrier media against the surface being decorated. Finally, the printed sublimation ink on the carrier film is heated to a temperature sufficient to sublime the ink to a vapor and decorate the shaped article. Typical sublimation temperatures are in the range of 150° C. to 215° C.

The lack of air permeability in the polymer film of the sublimation ink carrier media of the invention means that if an article to be decorated is enclosed within a sealed pouch made of the polymer film, a vacuum can be applied inside the pouch to make the film conform to the shaped article being decorated without the need for an additional external membrane for pressing the film against the shaped article. Doing away with the need for an external membrane is a significant advantage in itself, and also because it makes it unnecessary to insert a disposable protective sheet between the ink carrier media and the external membrane in order to protect the external membrane against contamination by the sublimation ink.

Materials that can be decorated using the sublimation ink carrier media of the invention and the ink sublimation decoration process of the invention include aluminum and other metals, wood, plastic, glass treated with an organic topcoat, and painted plastic or metal parts. Plastics that can be directly decorated according to the ink sublimation decoration process of the invention include polyesters, polyamides and polyacetal polymer resins.

EXAMPLES

The invention is further illustrated by the following examples. It will be appreciated that the examples are for illustrative purposes only and are not intended to limit the invention as described above. Modification of detail may be made without departing from the scope of the invention.

In the following example and comparative example, shaped polyacetal molded articles were decorated by ink sublimation using two different sublimation ink carrier media that had been identically printed. In Comparative Example 1, the carrier media was a knitted fabric, whereas in Example 2, the carrier media was a polyester elastomer film sublimation ink carrier media according to the invention. In each example, the carrier media was heliographically printed according to the printing process discussed above with the same detailed pattern using rotogravure equipment and a black sublimation ink. The sublimation ink used was Black Subli 648 obtained from Sensient of Morges, Switzerland. This ink was composed of dispersed dyes in alcohol. Each film was printed at a speed of 60 m/min, with a drying temperature of 40° C.

The sublimation process and apparatus used was the process and apparatus described in European No. EP 451 067. The object to be decorated was placed under the printed ink carrier media, and then inserted between two flexible membranes held by two articulated rigid frames. In each example, the object decorated was an injection molded polyacetal article having a hollow wedge shape with a long side of 50 mm, a width 39 mm, and a depth 15 mm. The polyacetal used was Delrin® 511P acetal polymer from DuPont of Wilmington, Del., U.S.A. The frames were closed such that the membrane pressed the ink carrier media against the shaped object being decorated. The entire apparatus was then passed through a continuous oven during which time a vacuum of 0.6 to 1.0 bars was applied between the flexible membranes. The oven had four 60 cm long zones and the frame passed through the zones at a speed of 75 cm/minute. The temperature profile of the four oven zones was 215° C., 210° C., 205° C., 200° C. After the frame exited the oven, the vacuum was released, the frame was opened, the ink carrier media was removed from the decorated object, and the decorated object was removed and inspected.

Comparative Example 1

The sublimation ink carrier media was a knitted polyester fabric having a thickness of 320 microns; a basis weight of 120 g/m$^2$, and a maximum elongation of 125%. The fabric was made using polyester fiber having a dtex of 78. The fabric stretched 31.3% in the machine direction under a tension of 5 MPa, and it stretched 73.1% in the transverse cross direction under a tension of 5 MPa.

The fabric was printed and the molded polyacetal article was decorated by sublimation as described above. The sublimated decoration was blurred and undefined. A photograph of the sublimated decoration is shown in FIG. 1.

Example 2

The sublimation ink carrier media was a copolyether ester polymer film extruded onto a paper support sheet. The copolyether ester contained about 92 weight percent of 1,4-butylene terephthalate short-chain ester units and about 8 weight percent of polytetramethylene ether glycol longchain ester units with a molecular weight of about 1000, a melting point of about 220° C., and a melt flow rate of about 13 g/10 minutes measured at a temperature of 240° C. under a 2.16 kg load. The copolyether ester was melted in two single screw extruders having diameters of 152 mm and 114 mm, respectively. The temperature profile of each of the extruder barrels was (back to front) 240° C., 245° C., 255° C., 255° C. such that the melt temperature of the polymer entering the die was 255° C. The polymer melt was cast extruded through a single flat 1620 mm wide die with an opening size set to produce a 15 micron thick film. The melt was extrusion coated directly onto a continuous sheet of 1680 cm wide paper as the paper entered a nip before passing around a 400 mm diameter roll at a linear speed of 60 m/min. The distance from the die opening to the paper was about 20 cm. As the paper traveled around the roll, the polymer was squeezed between the paper and the roll surface while the polymer solidified to form a polymer film on the paper surface. The paper was a calendered paper, having a basis weight of 62 gr/m$^2$, sold under the name Silca classic yellow 924 by Ahlstrom Papiervertrieb GmbH of Munich, Germany. The extruded copolyether ester film had a thickness of 15 micron and a peel strength of 0.13 N/1.5 cm. After the film was manually peeled from the paper, the film exhibited an elongation of 0.4% at 5 MPa and a tensile strength of 30.6 MPa.

Figure 2:
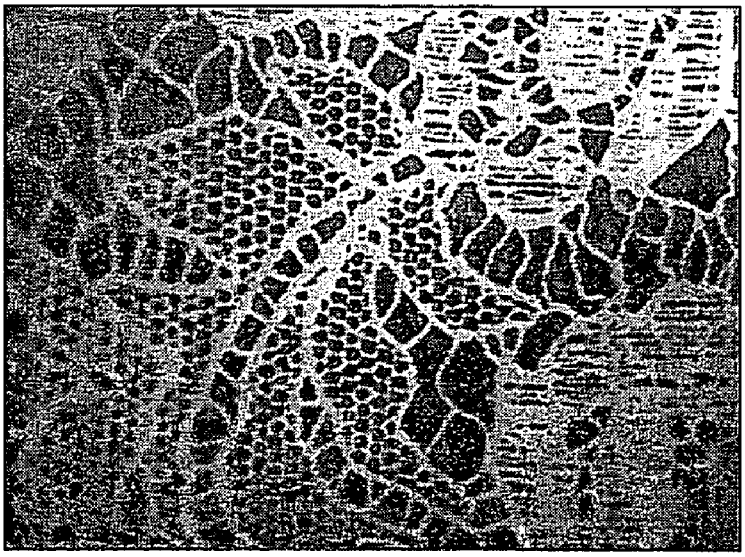
FIG. 2 is a photograph of a sublimated decoration printed with a sublimation ink carrier media according to the invention.

The film was printed as described above, was manually peeled from the paper and placed on the part to be decorated. The molded polyacetal article was decorated by sublimation as described above. The sublimated decoration was crisp and very clear. A photograph of the sublimated decoration is shown in FIG. 2.

Although a particular embodiment of the present invention has been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification and drawings, as indicating the scope of the invention.

It is claimed:

1. A sublimation ink carrier media comprising:

a support sheet having a planar surface, said sheet and planar surface having a machine direction and a substantially perpendicular cross direction, said support sheet being substantially non-extensible in said machine direction;

a polymer film having opposite first and second planar surfaces, said film and said film first and second planar surfaces having a machine direction and a substantially perpendicular cross direction, the first planar surface of said film being attached to the planar surface of the support sheet such that the machine directions of said support sheet and said polymer film are substantially aligned;

a sublimation ink printed in a pattern on the second planar surface of said film;

wherein when said polymer film is peelable from the planar surface of the support sheet, said polymer film is substantially non-extensible in the machine direction when the film is attached to the support sheet, said polymer film is extensible in the machine and cross directions after being peeled from said carrier support sheet, and said polymer film has a melting temperature of at least 190° C.

2. The sublimation ink carrier media of claim 1, wherein said polymer film is elastic in the machine and cross directions when peeled from said support sheet.

3. The sublimation ink carrier media of claim 2, wherein said polymer film is comprised of an elastomeric polymer.

4. The sublimation ink carrier media of claim 3, wherein said polymer film is comprised of a copolyester elastomer.

5. The sublimation ink carrier media of claim 4, wherein said polymer film is comprised of a copolyether ester elastomer.

6. The sublimation ink carrier media of claim 1 wherein the support sheet is a calendered paper.

7. The sublimation ink carrier media of claim 1 wherein the peel strength between the support sheet and the polymer film attached to the support sheet is in the range of 0.1 to 1.0 Newtons per 1.5 cm.

8. The sublimation ink carrier media of claim 1 wherein said polymer film has a tensile strength at yield of at least 4 MPa in the machine and cross directions after the film is peeled from said support sheet.

9. The sublimation ink carrier media of claim 1 wherein said polymer film has a thickness of from 10 to 30 microns after the film is peeled from said support sheet.

10. The sublimation ink carrier media of claim 1 wherein the elongation of the carrier film in the machine and cross directions when the film is peeled from the support sheet is at least 0.4% at a tension of 5 MPa.

11. The sublimation ink carrier media of claim 1 wherein the elongation of the carrier film in the machine and cross directions when the film is peeled from the support sheet is at least 0.8% at a tension of 5 MPa.

12. A process for the decoration of a shaped article by ink sublimation comprising the steps of:

selecting a polymer film and support sheet laminate, said support sheet having a planar surface, said sheet and planar surface having a machine direction and a substantially perpendicular cross direction, said support sheet being substantially non-extensible in said machine direction, and said polymer film having opposite first and second planar surfaces, said film and film first and second planar surfaces having a machine direction and a substantially perpendicular cross direction, the first planar surface of said film being attached to the planar surface of the support sheet such that the machine directions of said support sheet and said polymer film are substantially aligned;

feeding said polymer film and support sheet laminate through a printing apparatus in the machine direction of the polymer film and support sheet;

printing the second planar surface of the polymer film with one or more sublimation inks in the printing apparatus;

peeling the polymer film from the support sheet;

pressing the printed surface of the polymer film against the surface of the shaped article to be decorated such that the carrier film is extended and conforms to the surface being decorated;

heating the ink printed on the polymer film to a temperature sufficient to sublime the ink to a vapor and decorate the shaped object;

removing the polymer film from the shaped object.

13. The process for the decoration according to claim 12, wherein said polymer film is elastic in the machine and cross directions after the film is peeled from the support sheet.

14. The process for the decoration according to claim 13, wherein said polymer film is comprised of an elastomeric polymer.

15. The process for the decoration according to claim 14, wherein said polymer film is comprised of a copolyester elastomer.

16. The process for the decoration according to claim 15, wherein said polymer film is comprised of a copolyether ester elastomer.

17. The process for the decoration according to claim 12 wherein the support sheet is a calendered paper.

18. The process for the decoration according to claim 12 wherein a peeling force in the range of 0.1 to 1.0 Newtons per 1.5 cm is applied to peel the polymer film from the support sheet.

19. The process for the decoration according to claim 12 wherein in the step of heating the polymer film, the polymer film is heated to a temperature in the range of 200 to 250° C.

20. The process of claim for decoration according to claim 12 wherein the step of peeling the polymer film from the support sheet is followed by the steps of forming the film into an airtight pouch, placing the shaped article in the pouch, and applying a vacuum to the inside of the pouch to bring the film into contact with the shaped article.

* * * * *